US008439225B2

(12) United States Patent
Schick

(10) Patent No.: US 8,439,225 B2
(45) Date of Patent: May 14, 2013

(54) DISPENSER OR SIMILAR DISCHARGING CONTAINER

(75) Inventor: Werner Schick, Neuenkirchen (DE)

(73) Assignee: Poppelmann Holding GmbH & Co. KG, Osnabrück, Deutschland ( * ) Notice: Subject to any disclaimer, the term of this patent is extended or adjusted under 35 U.S.C. 154(b) by 271 days.

(21) Appl. No.: 12/678,910

(22) PCT Filed: Sep. 19, 2008

(86) PCT No.: PCT/EP2008/007861

§ 371 (c)(1),
(2), (4) Date: Jun. 25, 2010

(87) PCT Pub. No.: WO2009/043489

PCT Pub. Date: Apr. 9, 2009

(65) Prior Publication Data

US 2010/0258582 A1 Oct. 14, 2010

(30) Foreign Application Priority Data

Sep. 27, 2007 (DE) ..... 20 2007 013 517 U
Feb. 13, 2008 (DE) ..... 10 2008 009 021

(51) Int. Cl.
*B65H 3/00* (2006.01)

(52) U.S. Cl.
USPC ..... 221/263; 221/264; 221/268

(58) Field of Classification Search ..... 221/263, 221/264, 268
See application file for complete search history.

(56) References Cited

U.S. PATENT DOCUMENTS

| | | | | |
|---|---|---|---|---|
| 4,564,124 | A * | 1/1986 | Burton | 221/263 |
| 4,854,478 | A * | 8/1989 | Gyimothy | 221/263 |
| 5,018,644 | A * | 5/1991 | Hackmann et al. | 221/263 |
| 6,273,294 | B1 | 8/2001 | Petzold et al. | |
| 7,243,817 | B2 * | 7/2007 | Giraud | 221/263 |
| 7,273,156 | B2 * | 9/2007 | Gao et al. | 221/47 |
| 7,353,969 | B2 * | 4/2008 | McHutchinson | 221/88 |
| 7,988,016 | B2 * | 8/2011 | Klein et al. | 221/263 |

FOREIGN PATENT DOCUMENTS

| | | |
|---|---|---|
| EP | 0600123 | 6/1994 |
| FR | 2792621 | 10/2000 |
| WO | WO 94/14682 | 7/1994 |
| WO | WO 2006/116370 | 11/2000 |

* cited by examiner

*Primary Examiner* — Timothy Waggoner
(74) *Attorney, Agent, or Firm* — Husch Blackwell LLP; Robert C. Haldlman; H. Frederick Rusche

(57) ABSTRACT

The invention relates to a dispenser or similar discharging container, particularly for lump form food (5), having a housing (1), the bottom side (2) of which determines an installation plane, and having a gate (6) disposed in the housing (1) in a movable fashion that, when activated, is moved with a circumferential region (17) past an edge (8) of the housing (1), characterized in that said dispenser comprises an appendage (9) connected to the gate (6) via at lest one target breaking section (10); upon the activation of said gate, said appendage impacts the edge (8). The dispenser further comprises at least two feet (11) extending downward through the installation plane.

21 Claims, 3 Drawing Sheets

DISPENSER OR SIMILAR DISCHARGING CONTAINER

FIELD OF THE INVENTION

The present invention concerns a dispenser or similar discharging container, in particular for pieces of foodstuffs, with a housing, whose underside defines a mounting plane and with a pusher movably disposed in the housing, which by its operation is moved with a circumferential area to an edge of the housing.

BACKGROUND OF THE INVENTION

Dispensers according to the general specification of claim 1 are known, for example, as tablet or sweetener dispensers. Sweetener tablets or other items in pieces are discharged in portions from a discharge opening, usually underneath, by operating the pusher and consequently are controlled. Transporting the filled dispensers and laying them down is done in a stack, as a rule, in several layers, one on top of the other. Due to the pressure of the dispensers standing on top of one another, a dispenser located right in the bottom row is frequently inadvertently operated. The pusher of the dispenser is pressed in and the dispenser is then not unused any longer. In the extreme case, foodstuff can be lost. In addition, the customer can see that a dispenser has already been operated, and in his eyes it might possibly not be still new.

It is the object of the present invention to create a dispenser in which the inadvertent operation of the dispenser is prevented, particularly during transport and upon laying one dispenser on top of another.

The object is achieved by a dispenser with the characteristics of claim 1. Advantageous embodiments can be drawn from the subclaims.

SUMMARY OF THE INVENTION

The dispenser according to the invention is distinguished by a projection attached by at least one pre-defined breakage tab to the pusher which is pressed to the edge during its operation. By means of this projection, pressing/operating the dispenser and moving the circumferential area along to the edge is mechanically blocked. Inadvertent operation of the dispenser with pressing and breaking off the projection at the breakage tab leads to visible damage to the dispenser, which can then be set aside.

Additionally, the dispenser exhibits at least two feet, which emerge downward through the mounting plane at the bottom of the dispenser during operation of the pusher. The feet are connected to the pusher and block its inadvertent movement, if the dispenser is on a base. It can be operated if it is first held, for example, above a coffee cup and the pusher, often provided with a button on top and thus being operable in a simple manner, is pressed. The use of two feet serves as optimum support underneath the pusher and for its protection from unintentional operation. The pusher is doubly supported. In addition, the dispenser can also not be manipulated either without noticing.

Advantageously, the dispenser is provided with a projection, which, especially by means of several breakage tabs, is constructed as a strip running along the edge. For example, this strip is disposed on a button or trigger constructed as part of the pusher. The pusher is thus not only isolated but also, in the ideal case, supported all around by a strip constructed as a ring. Loading a spring provided to reset the pusher after operation, accompanied by violation of dispenser integrity, is thus avoided as well. Removal of the strip can be further improved if it is arranged so it can be torn off, either just partially or by breaking it off along the edge.

In a further advantageous embodiment, a loop is disposed on the projection. This loop is, for instance, constructed as a transport safeguard that can be withdrawn transverse to the movement direction of the pusher and thus prevents the pusher from being pressed in. The pusher can be moved after first removing this transport safeguard.

The loop is constructed in a further advantageous embodiment on the projection and further is preferred to be integral with it. The breakage sites can be constructed here as reinforced, since a greater force can be exerted by means of the loop on the projection and the breakage sites. The customer grasps the loop and separates the projection, preferably constructed as an integrity ring, by means of the force exerted by the loop. Violation of the integrity of the dispenser can only occur on purpose. For improved tearing off of the loop, the breakage tabs lying directly on the loop are constructed as weaker than breakage tabs disposed farther away. It is also within the scope of the invention to have the strip running around the edge to form a loop farther away in a section of the circumferential area and, for example, to running in a U-shape.

Advantageously, the projection is affixed to the pusher set back from the edge, so that the breakage tab (by itself, if the dispenser is on a soft base such as cardboard, for example) is not damaged by the feet emerging slightly through the mounting plane. As a measure of the distance, a range of 1-3 mm is advantageously offered, preferably 1 to 1.5 mm.

In order to be able to hold on to the loop better, it is preferably provided with a shaped gripping surface. Alternatively or complementarily, it exhibits a border in the form of a thickening at the edge, by means of which sufficient force can be applied by means of the fingertip and/or fingernail, even with small loops.

Moreover, the loop can be constructed for a better grip if it is constructed in the form of a ramp, observed in vertical section, that is, starting from the projection, it is provided with a greater existing thickness for the edge lying farther away from the projection, In a further advantageous embodiment, the dispenser is constructed to be oval in cross-section and the loop is disposed in the transition area from a short side to a long side of the dispenser. Greater packing densities thereby result when transporting dispensers provided with loops.

The conscious tearing off of the projection by a user of the dispenser can, by an uncontrolled application of force, lead to partially tearing off the projection, if this force is not applied uniformly. In areas prone to tearing, it is therefore an advantage to reinforce the projection. It can be partially thickened along its circumference with an integrity ring.

For optimum support of the feet at the base, these are disposed on opposite sides of the bottom.

If the dispenser has not been operated, the feet are located inside the outer housing. Preferably, the feet are disposed on the inside of the housing along the side wall, in order, on the one hand, to allow sufficient room for an isolating mechanism and on the other hand to improve control of the pusher connected to the feet.

In the extreme case, the feet of the dispenser can form a closed circumferential ring, which, when operating the dispenser, emerges downward through the mounting plane, constituting very good support and security, and in the center of which is the isolating mechanism mentioned.

A discharge opening of the dispenser according to the invention, which can be released by operating the pusher, is preferably disposed centrally between the feet and in this way can be protected during operation from unconscious sealing by hand.

In a further advantageous embodiment of the invention, the dispenser includes a ramp fastened to one part of the dispenser for guiding the foodstuff in the direction of the discharge opening, in which the ramp is movable relative to the part of the dispenser for changing the position of the items and is supportable directly or indirectly on a housing part. Preferably, this involves a part belonging to the pusher in one part of the dispenser, so that the elastic ramp is operated when operating the pusher. At the same time, a force can be produced by partially supporting the ramp on the housing, by which the movement of the pusher is impeded. The ramp additionally produces a supplementary restoring force for the spring that is there, as a rule. Unconscious operation of the pusher and possible violation of integrity are hereby prevented in addition.

BRIEF DESCRIPTION OF THE DRAWINGS

Further advantages and particulars of the invention may be deduced from the following description of the schematic illustrations in the figures.

DETAILED DESCRIPTION OF CERTAIN PREFERRED EMBODIMENTS

Identically or similarly operating parts are provided in the following, as an aid, with identical reference numbers. The individual technical characteristics described hereinafter can also lead, in combination with the previously described characteristics, to advantageous embodiments of the invention.

Figure 1:
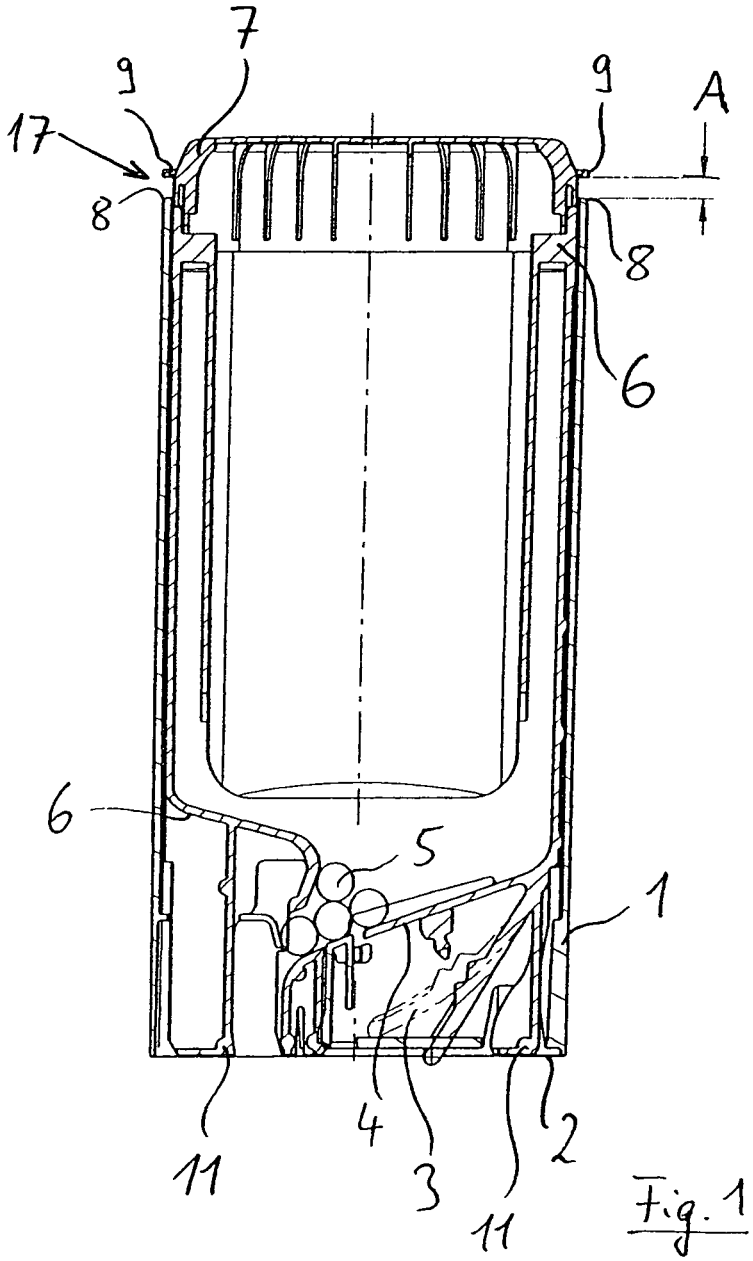
FIG. 1 a vertical section through a dispenser according to the invention in the unoperated position.

The dispenser according to FIG. 1 is provided with a housing 1, whose bottom 2 defines a mounting plane. Without a housing bottom 2, the spring 3 of the dispenser is not drawn dashed in the figure but takes the position traced. Pieces of foodstuff 5 are arranged on a ramp 4, which can be individually portioned out by an isolating mechanism, not described in detail.

Figure 3:
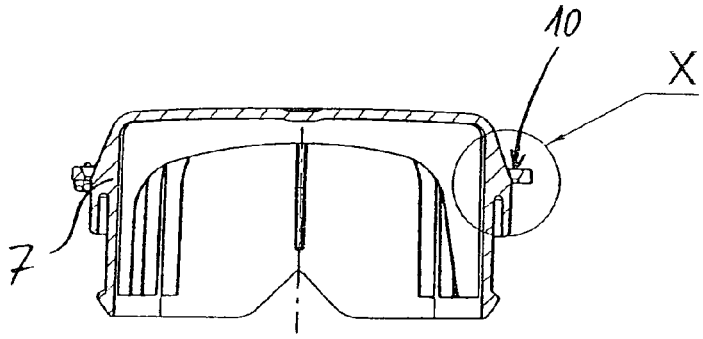
FIG. 3 a further, partial vertical section of the object according to FIG. 1.
Figure 4:
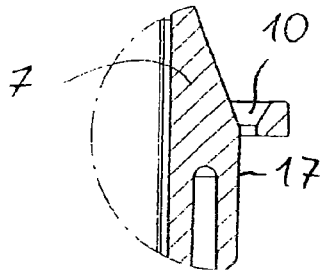
FIG. 4 the detail X according to FIG. 3.

Inside the housing 1 is disposed a pusher 6, which includes a top button 7. By operating the button 7, or rather the pusher 6, it is moved downward relative to the housing 1, whereby a circumferential area 17 is moved along to an edge 8. The distance A between the edge 8 and a projection 9 is hereby reduced enough for the projection 9 to hit the edge 8 and, with a sufficiently large force, to break off along a breakage tab 10, clearly discernible in FIGS. 3 and 4. For the purpose of simplified manufacture, the button 7 is constructed to be integral with the breakage tab 10 and with the projection 9 constructed as an integrity ring. The distance A is preferably between 1 and 1.5 mm, and 1.2 mm is particularly preferred.

Nearly flush with the bottom 2, the pusher exhibits two feet 11, which upon operation emerge downward through the mounting plane. Provided that a base is available, the feet 11 block pressure upon and operation of the pusher and prevent violation of integrity. The feet 11 adjoin the inside of the housing 1 on opposite sides.

Figure 2:
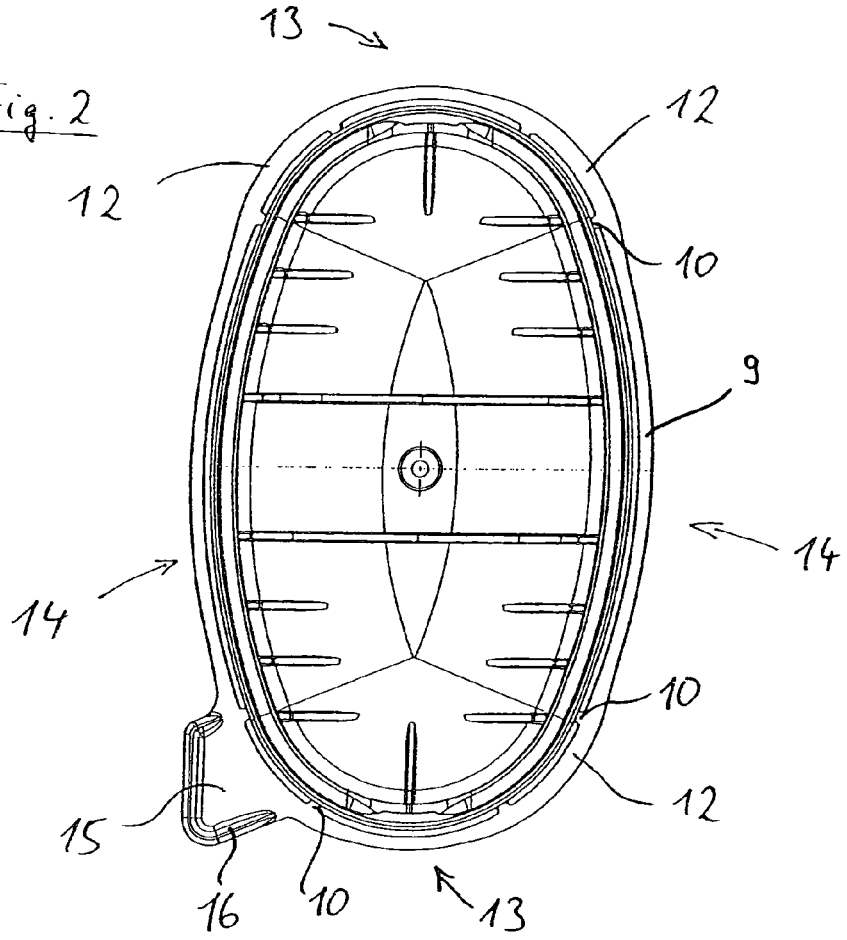
FIG. 2 the object according to FIG. 1 in plan view.

Additionally, integrity is ensured by the projection shown in the plan view according to FIG. 2. In some areas 12, the cross-section of the projection 9 constructed as a ring is thickened, in order to make better removal of the ring and separation of the breakage tab 10 possible.

In an area of transition from a short side 13 to a long side 14, a loop 15 is disposed on the projection, which serves for peeling off the ring. Peeling off the integrity ring by means of the loop requires a smaller expenditure of force than breaking the ring by means of the simple operation of the button 7 or its included pusher 6. As a result, it is possible to adjust the shear force such that inadvertent operation of the dispenser in its original state is effectively prevented. At the bottom of the loop, not depicted, this exhibits a fairing on its gripping surface. Additionally, the loop 15 is provided with a border 16 for the purpose of a better grip. The circumferential area 17 may be deduced in still further detail from FIG. 4. The breakage tabs 10 disposed in the region of the loop 15 are constructed as somewhat weaker than the rest of the breakage tabs 10.

Figure 5:
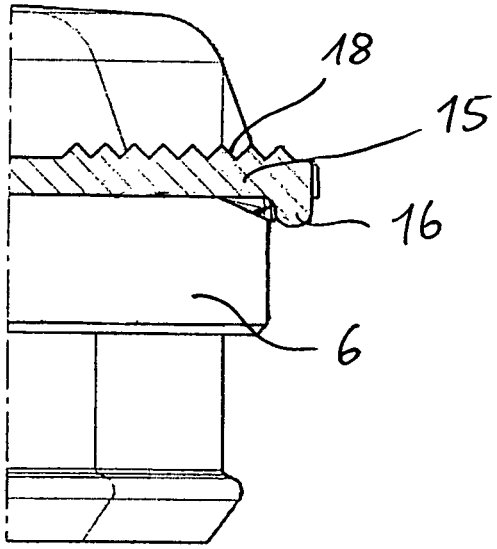
FIG. 5 a detail of a further embodiment example according to the invention.

The loop 15 of a further embodiment according to the invention is shown in FIG. 5. In addition to the fairing 18 now disposed on the top of the loop, this loop 15 likewise exhibits a border 18 now pointing downward.

I claim:

1. A dispenser for pieces of foodstuffs (5), said dispenser comprising a housing (1), whose underside (2) defines a mounting plane, a pusher (6) movably disposed in the housing (1), which upon its operation is moved with a circumferential area (17) at one edge (8) of the housing (1), a projection (9) connected by means of at least one breakage tab (10) to the pusher, and at least two feet (11) emerging upon operation of the pusher (6) downward through the mounting plane.

2. A dispenser according to claim 1, wherein the projection (9) is constructed as a strip running along the edge (8).

3. A dispenser according to claim 1, wherein a loop (15) is disposed on the projection (9).

4. A dispenser according to claim 3, wherein the loop (15) is disposed on the projection (9).

5. A dispenser according to claim 4, wherein the loop (15) is constructed integral with the projection (9).

6. A dispenser according to claim 3, wherein the loop (15) exhibits a border (16).

7. A dispenser according to claim 3, wherein the loop (15) is constructed in the form of a ramp.

8. A dispenser according to claim 3, wherein the dispenser is oval in cross-section and a disposition of the loop (15) is in the area of transition from a short side (13) to a long side (14) of the dispenser.

9. A dispenser according to claim 1, wherein the projection (9) is reinforced to strengthen the area prone to tearing off.

10. A dispenser according to claim 1, wherein the feet (1) are disposed on opposite sides of the bottom (2).

11. A dispenser according to claim 1, wherein the feet (11) are movable along the inside of the housing (1).

12. A dispenser according to claim 1, wherein the feet (11) of the dispenser form a closed circumferential ring, which emerges during operation of the dispenser downward through the mounting plane.

13. A dispenser according to claim 1, wherein the dispenser exhibits a discharge opening for isolated foodstuffs (5), which can be released by operating the pusher (6) and is disposed between the feet (11).

14. A dispenser according to claim 13, further comprising a ramp (4) fastened onto a part of the dispenser to guide the foodstuffs (5) in the direction of the discharge opening, whereby the ramp (4) is movable against the part (6) of the dispenser for changing the position of the foodstuff (5) and is supportable on the housing part (2).

15. A dispenser according to claim 1, wherein there are at least two of the breakage tabs (10), and wherein one of the breakage tabs (10) is constructed weaker than the other breakage tab for simpler removal of the projection (9).

16. A dispenser according to claim 1, wherein the projection (9) itself exhibits breakage sites.

17. A dispenser according to claim 2, wherein the loop is disposed on the projection.

18. A dispenser according to claim 3, wherein the loop is provided with a faired gripping surface.

19. A dispenser according to claim 4, wherein the loop exhibits a border.

20. A dispenser according to claim 5, wherein the loop exhibits a border.

21. A dispenser for pieces of foodstuffs (5), said dispenser comprising a housing (1), whose underside (2) defines a mounting plane, a pusher (6) movably disposed in the housing (1), which upon its operation is moved with a circumferential area (17) at one edge (8) of the housing (1), a projection (9) connected by means of at least one breakage tab (10) to the pusher, and at least two feet (11) emerging upon operation of the pusher (6) downward through the mounting plane, and wherein the feet (11) of the dispenser form a closed circumferential ring, which emerges during operation of the dispenser downward through the mounting plane.

* * * * *

UNITED STATES PATENT AND TRADEMARK OFFICE

CERTIFICATE OF CORRECTION

PATENT NO. : 8,439,225 B2
APPLICATION NO. : 12/678910
DATED : May 14, 2013
INVENTOR(S) : Werner Schick It is certified that error appears in the above-identified patent and that said Letters Patent is hereby corrected as shown below:

On the Title page, item [57], delete "lest" and replace with --least--

Signed and Sealed this
Eighth Day of October, 2013

Teresa Stanek Rea
*Deputy Director of the United States Patent and Trademark Office*

UNITED STATES PATENT AND TRADEMARK OFFICE

CERTIFICATE OF CORRECTION

PATENT NO. : 8,439,225 B2
APPLICATION NO. : 12/678910
DATED : May 14, 2013
INVENTOR(S) : Werner Schick It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 359 days.

Signed and Sealed this
Eighth Day of September, 2015

Michelle K. Lee

Michelle K. Lee
*Director of the United States Patent and Trademark Office*